US005142764A

United States Patent [19]

Whiteside

[11] Patent Number: 5,142,764

[45] Date of Patent: Sep. 1, 1992

[54] METHOD FOR TACK-FREE POSITIONING OF AIRCRAFT COMPONENTS FOR SUBSEQUENT FASTENING

[75] Inventor: Trevor D. Whiteside, Redondo Beach, Calif.

[73] Assignee: The United States of America as represented by The Secretary of The Air Force, Washington, D.C.

[21] Appl. No.: 621,696

[22] Filed: Nov. 28, 1990

[51] Int. Cl.[5] ..... B23P 11/02

[52] U.S. Cl. ..... 29/559; 29/525.2; 29/897; 29/897.2; 29/281.1; 269/32

[58] Field of Search ..... 29/525.2, 559, 281.1, 29/721, 712, 281.3, 281.4, 897, 897.2; 269/32, 56, 104

[56] References Cited

U.S. PATENT DOCUMENTS

| | | | |
|---|---|---|---|
| 2,342,025 | 2/1944 | Watter | 29/281.1 |
| 2,378,043 | 6/1945 | Sorensen et al. | 29/281.1 |
| 2,430,438 | 11/1947 | Watter et al. | 29/148.2 |
| 2,451,454 | 10/1948 | Watter | 29/148.2 |
| 2,567,124 | 9/1951 | Roberts | 244/124 |
| 3,643,900 | 2/1972 | Maloney | 244/123 |
| 3,827,661 | 8/1974 | Ryan et al. | 244/123 |
| 4,295,262 | 10/1981 | Grote et al. | 29/559 |
| 4,682,765 | 7/1987 | Mainville | 269/32 |
| 4,894,903 | 1/1990 | Woods | 29/559 |

*Primary Examiner*—P. W. Echols
*Assistant Examiner*—David P. Bryant
*Attorney, Agent, or Firm*—Thomas C. Stover; Donald J. Singer

[57] ABSTRACT

A spar assembly jig for tack-free positioning of aircraft spar components for subsequent fastening at a second location is provided. Pneumatically operated clamps are mounted on the frame of such jig. The spar components are laid up in such jig and the clamps closed thereon to hold the members together as opposed to the prior art method of securing such components together by temporary fasteners or tacking. The assembly jig and so-assembled and clamped spar components are than transported by overhead crane to an automatic riveting machine. The jig and spar components are lowered into place before such riveting machine, which has a jaw defined by a spindle and anvil which fits above and below the jig assembly. The clamps have a swing-away feature such that as the spindle and anvil approach eg. an area where a clamp holds an endcap to a web of a spar, the clamp swings away therefrom and out of the way of the spindle above and anvil below so that such machine can drive a rivet through endcap and web at or near the spot vacated by the swing-away clamp. The machine then moves on and the clamp re-closes on the spar components. After riveting of the spar components is completed, the jig assembly and so-fastened spar therein can be lifted off the riveting machine and transported away by overhead crane to storage or to the next work station, which promptly frees up the riveting machine for another operation. Accordingly method and apparatus for positioning, clamping and riveting components of a structure together, in a no-tack operation is provided.

4 Claims, 5 Drawing Sheets

METHOD FOR TACK-FREE POSITIONING OF AIRCRAFT COMPONENTS FOR SUBSEQUENT FASTENING

FIELD OF THE INVENTION

This invention relates to method and apparatus for assembling aircraft components particularly for positioning such components with a jig assembly for fastening same.

THE PRIOR ART

Assembling and fastening together elements of aircraft components is a multi-step process. For example, elements of a wing spar assembly includes, e.g. an aluminum web, two angle caps and several stiffeners. Once these elements or details are located, a problem lies in the high man-hour requirements needed to prepare and position the elements for assembly in an automatic fastening operation as found in modern aircraft assembly plants. Such preparation process would normally require the manual drilling and installation of many (eg. 500) temporary fasteners (tacking) to hold the spar assembly in position, as guided by a jig for that purpose. After the tacking process, the spar assembly is then removed from the assembly jig and transferred to a fastening stage to be fastened e.g. by rivets.

In the prior art, several patents relate to aircraft structures and methods of assembly including U.S. Pat. No. 3,827,661 to Ryan et al. (1974), U.S. Pat. No. 3,643,900 to Malony (1972), U.S. Pat. No. 2,567,124 to Roberts (1951) and U.S. Pat. No. 2,430,438 to Watter et al (1943). Although these patents relate to the assembly of airfoils and at least one, the Ryan reference, mentions the use of quick-release fasteners to hold the assembly in alignment before riveting same, but appears to take no notice of the tacking problem, let alone suggest a solution therefor.

The above-mentioned assembly and positioning of spar elements in a jig, normally requires a considerable number of man hours for installing what are only temporary fasteners, i.e. tacking, as noted above.

Accordingly, there is a need and market for a jig assembly method and apparatus that omits or eliminates tacking in the assembly of aircraft components and otherwise obviates the above prior art shortcomings.

There has now been discovered method and apparatus for jig assembly and positioning of aircraft components that employs a "no tack" concept that significantly reduces the man hour costs in jig assembly preparation for subsequent permanent fastening of aircraft elements and/or components.

SUMMARY OF THE INVENTION

Broadly the present invention provides a structure assembly jig (AJ) for tack-free positioning of structure components for subsequent fastening comprising, a frame for positioning the components in a desired assembly, movable clamp members mounted to the frame and means to move the clamps into pressure contact with the components, to hold them in place in the frame so that such components can be fastened without tacking.

The invention further provides a structure assembly jig in which the structure components are assembled in a desired position at a first location, clamped in place and then the jig (or frame) and the components are moved to a second location for fastening the so-clamped components to form such structure after which the clamps are opened to release such structure from the jig.

The invention also provides a method for structure assembly in a jig for tack-free positioning of components for subsequent fastening comprising, assembling the components in a frame in desired positions, clamping the components in place in such frame and fastening the so-clamped components together to form a structure without a pre-tacking step.

BRIEF DESCRIPTION OF THE DRAWINGS

The invention will become more apparent from the following detailed specification and drawings in which.

DESCRIPTION OF PREFERRED EMBODIMENT

Figure 1:
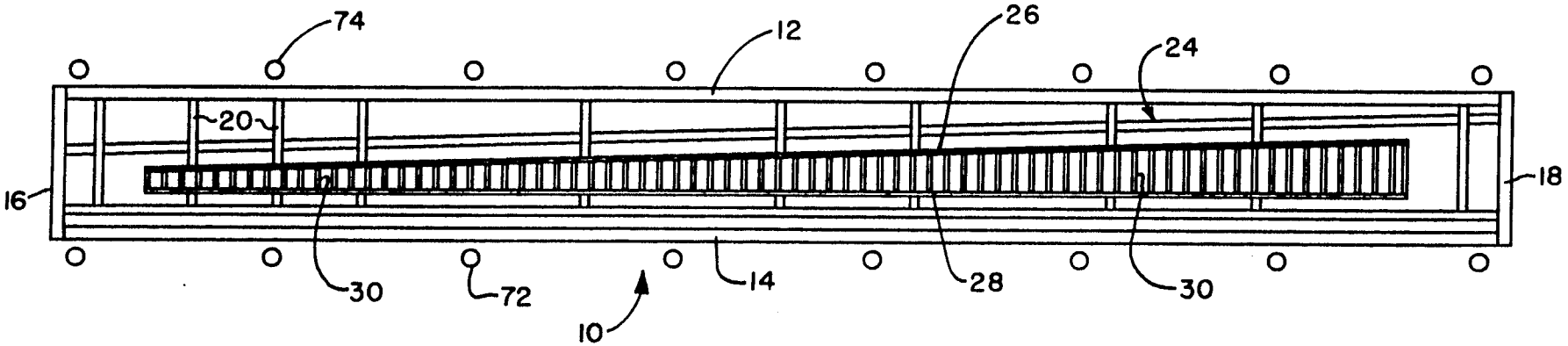
FIG. 1 is a plan view of an assembly jig embodying the present invention.
Figure 2:
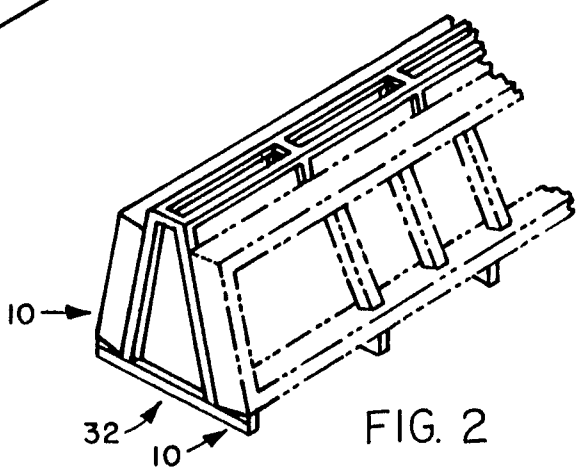
FIG. 2 is a fragmentary perspective view of an assembly station for the jig of FIG. 1.

Referring in more detail to the drawings, spar assembly jig (AJ) 10 has elongated frame members 12 and 14, which are connected by cross members 20 and end frame members 16 and 18, as shown in FIG. 1. Within such frame and on the cross members 20 is mounted a tapering ladder-like structure or contour board 24, which has rails 26 and 28 connected by cross ties 30 of diminishing length, as shown in FIGS. 1 and 6. Mounted to the rails 26 and 28 or cross ties 30 of the contour board 24, at intervals, are pneumatically operated clamps 36, which upon electrical signal, swing from closed to open position and vice versa, as shown or indicated in FIGS. 5 and 6. Such jig 10 is placed in a work station 32, as shown in FIG. 2. At the work station 32, a structure, e.g. a wing spar is laid up or assembled, as follows. A web 40 of eg. aluminum is laid on the cross ties 30 of the contour board 24 between the rails 26 and 28. Then end caps 42 and 44 are positioned over the longitudinal edges of the web 40, adjacent and inside such rails 26 and 28, whereupon the pneumatic clamps 36 close and clamp the end caps 42 and 44 against the web 40 and against the underlying contour board 24, as shown or indicated in FIGS. 5 and 6.

In the prior art such components would be joined by a laborious tacking process in an assembly jig rather than by clamping per the present invention.

Figure 5:
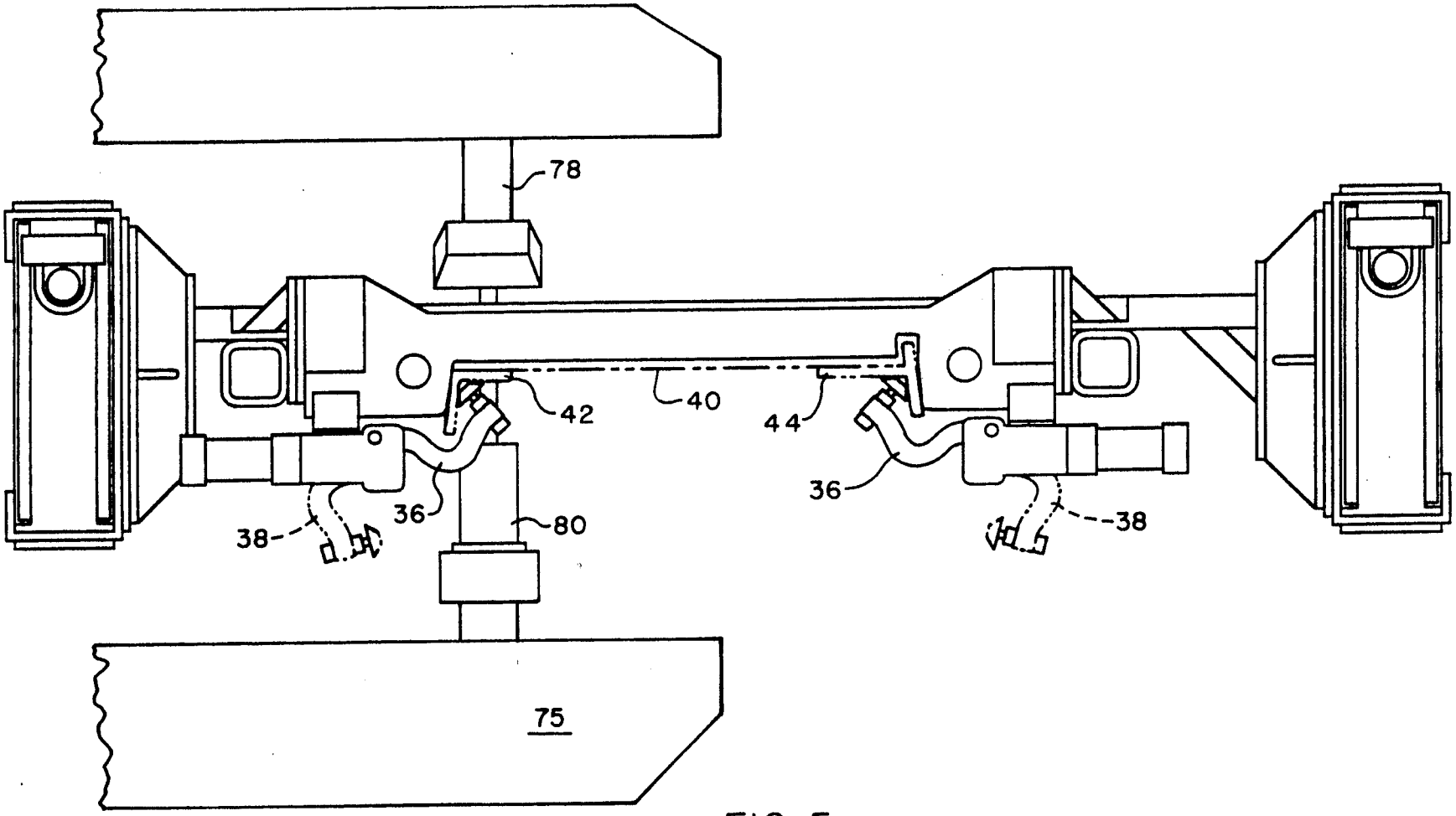
FIG. 5 is an elevation view partly in section, of the jig of FIG. 4, taken on lines 5—5, looking in the direction of the arrows
Figure 6:
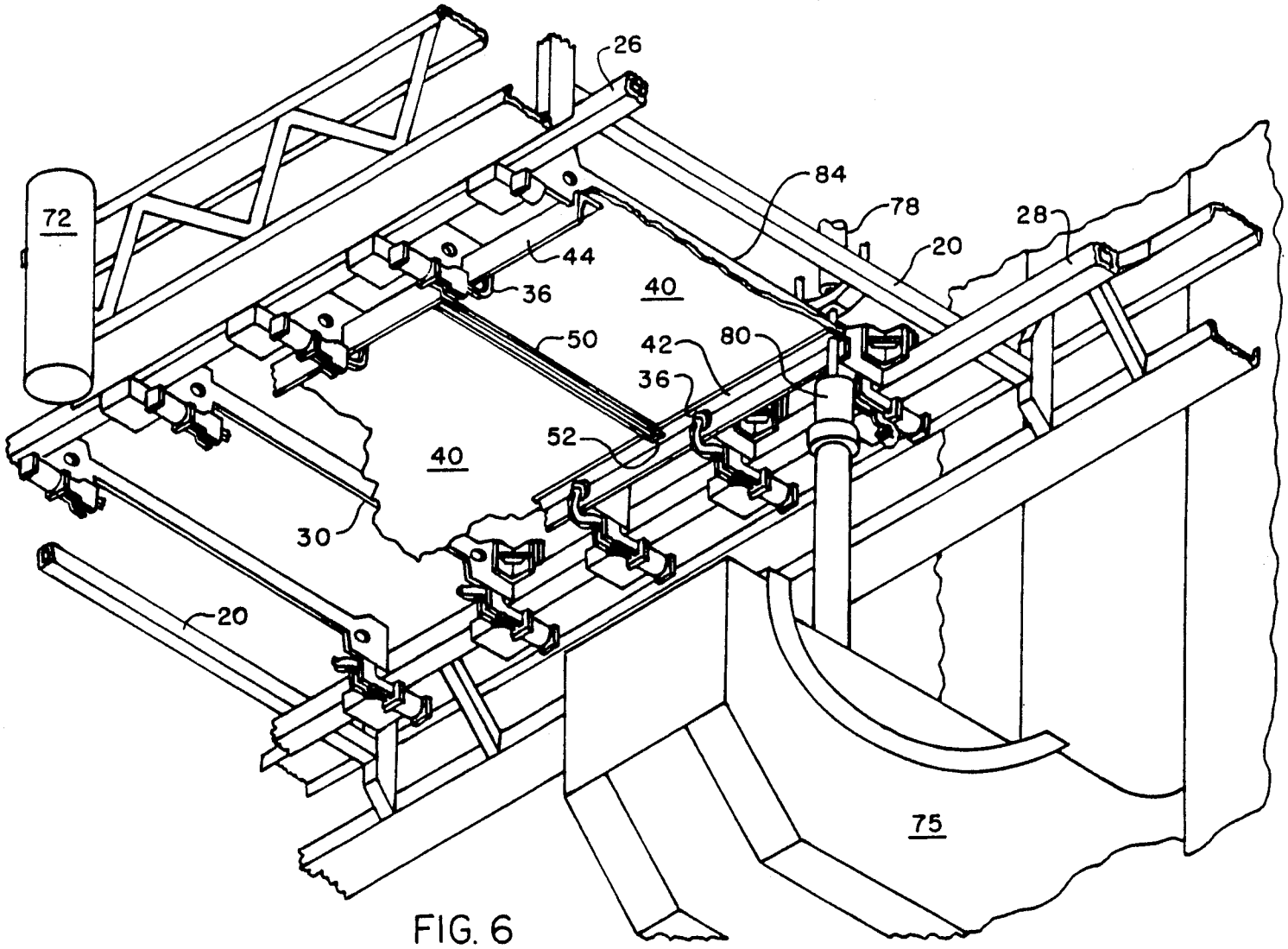
FIG. 6 is an enlarged bottom fragmentary perspective view of the assembly jig of the invention shown in FIGS. 4 and 5.

At this point spar stiffeners such as 'T' angles 50, can be installed across the web 40 and the end caps 42 and 44 and tacked, e.g. at apertures 52 to such endcaps or clamped per the invention e.g. with clamps 36, as indicated in FIG. 5.

However, it is preferred to tack all such stiffeners in place as otherwise a great number of additional clamps (above, e.g. 50 per endcap, already employed) would be required in the assembly jig 10 of the present invention.

Figure 3:
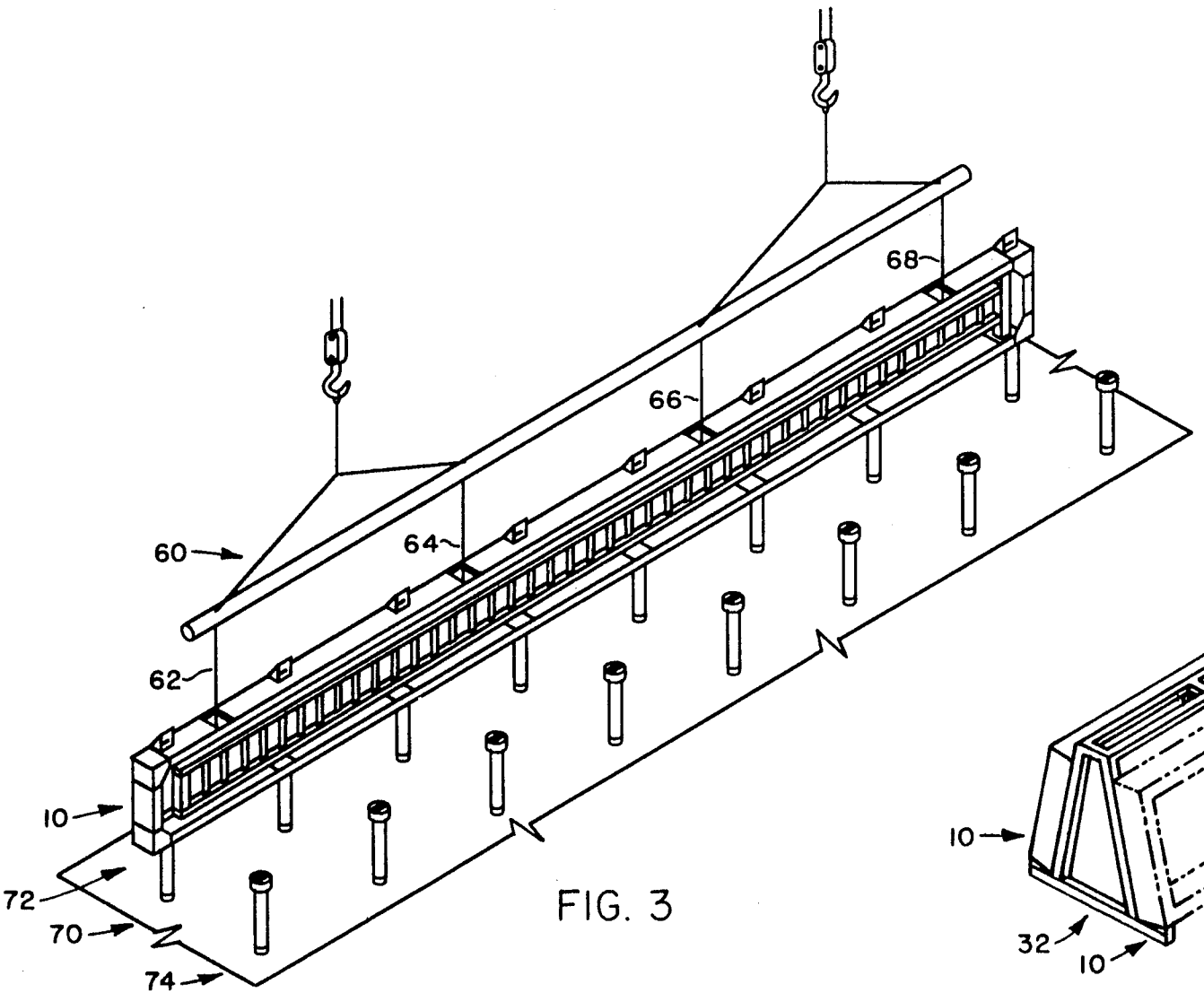
FIG. 3 is a perspective view of the jig of FIGS. 1 and 2 being transferred to a fastening station.
Figures 4, 4A:
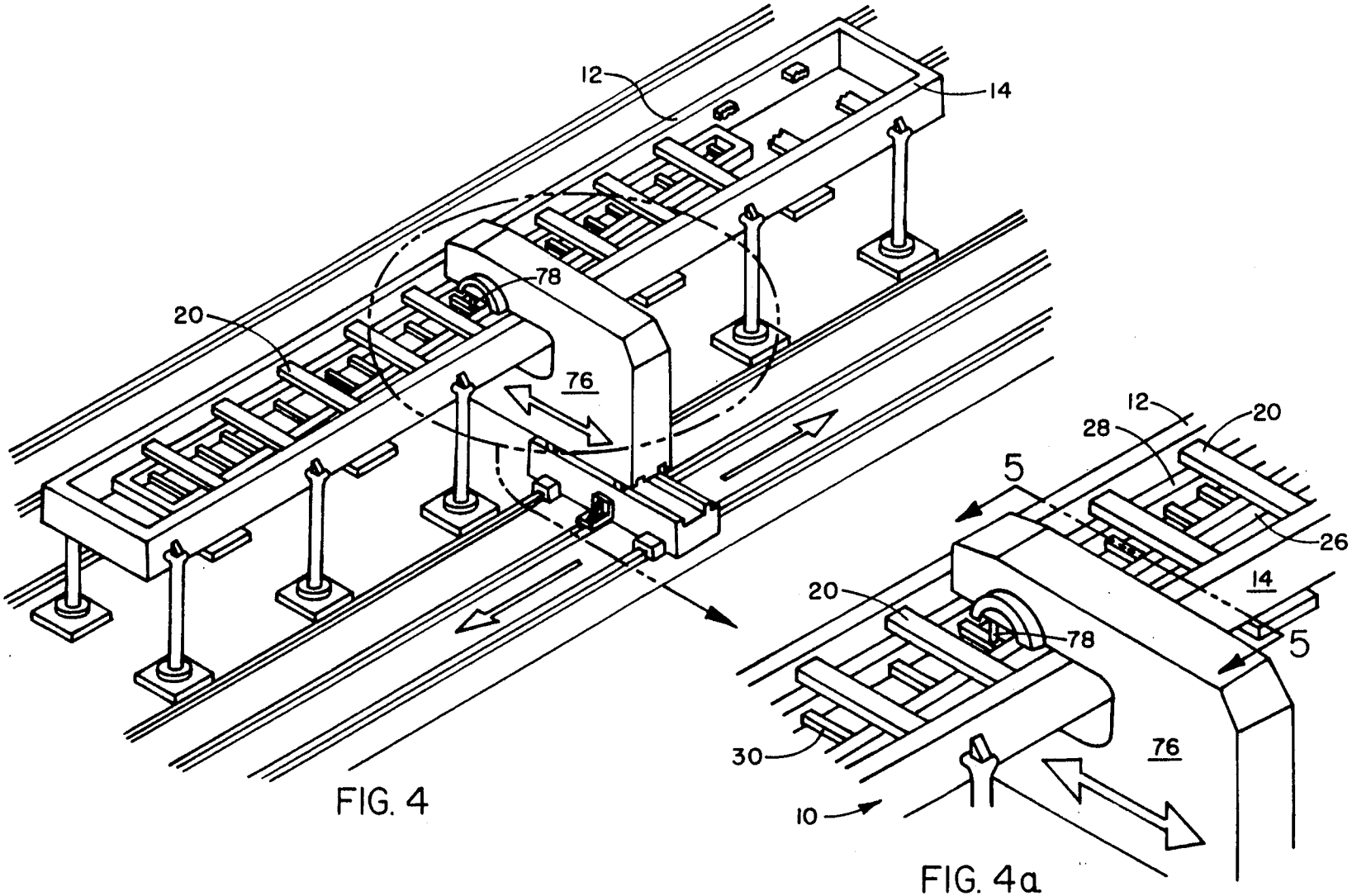
FIG. 4 is a top fragmentary perspective view of the assembly jig of the invention in place at the fastening station.
FIG. 4*a* is an enlarged fragmentary perspective view of a portion of the assembly jig shown in FIG. 4.

With the spar web fully clamped, as indicated in FIGS. 5 and 6, in the work station 32, shown in FIG. 2, an overhead crane 60 is moved into position over the assembly jig 10 and connected thereto by lines 62, 64, 66, and 68 and such jig 10 is lifted out of the work station 32 of FIG. 2 and carried to fastening station 70, lowered on a row of posts 72 and then pivoted so that the upper frame member 12 is lowered onto a second row of posts 74, as shown or indicated in FIGS. 3 and 4. The clamped spar components are now on the under surface of the assembly jig 10, as shown or indicated in FIGS. 5 and 6.

Then an automatic riveting machine or "drivmatic" 76, having a jaw 75, moves such jaw into position over and under the assembly jig 10, as indicated in FIGS. 4 and 5. At the approach of such jaw 75, having retractable spindle quill 78 and anvil 80, a closed pneumatic clamp 36 swings to the open position 38, to make room for such anvil (and spindle), which close on the spar assembly and rivet endcap 42 to web 40, as shown or indicated in FIGS. 5 and 6.

Thus the riveting of the spar assembly proceeds with the retractable spindle quill 78 "hopping over" successive cross ties 30 and with successive (closed) pneumatic clamps 36, pivoting to the open position 38, ahead of the advancing drivmatic spindle quill 78 and anvil 80, which drills and rivets endcap and web together under the opened clamp and moves on. The clamps 36 then close back in succession on the so-fastened endcap and web portions, behind the moving jaw 75, until the endcap 42 is riveted along its length to the web 40 and reclamped and thereafter the opposite endcap 44, is likewise riveted (and reclamped) to the web 40, to form the completed spar 84, as indicated in FIGS. 5 and 6. The spar is thus reclamped to hold it securely in the AJ.

The overhead crane 60 then returns and is connected by lines 62 to 68 to the jig assembly 10, which is lifted off the riveting station rows of support posts 74 and 72, as indicated in FIG. 3 and transported, e.g. back to the work station 32, shown in FIG. 2, where the clamps 36 open for removal of the spar from the jig assembly and the process can be repeated with new spar components.

A similar process and jig assembly is employed for assembly of aircraft skin panels and other aircraft components or other structures.

In aircraft construction, such an assembly jig can be 100 feet long and 5 feet wide with, e.g. 50 clamps mounted at each side of the contour board, about 30 in. apart. Such AJ can serve to assemble, clamp and fasten, e.g. aircraft spars and skin panels up to 90 ft. long or more.

The invention thus provides a relatively rapid assembly of, e.g. aircraft components such as spar assemblies, which are clamped in a jig, while omitting the laborious process of manual drilling and temporary tacking of the components together.

Thus the jig assembly of the present invention provides a "no tack" concept that significantly reduces the man hour costs in assembly of a spar or other structure, in preparation for drivmatic fastening operations. Also, as the so-clamped spar components in the jig assembly, can be readily transported, to a fastening area, e.g. a rivet machine, the parts are rapidly fastened together, while remaining (clamped) in such jig, which jig can then be rapidly removed to free-up the rivet machine for another operation. Prior art methods have required that a rivet machine be dedicated or tied-up in the assembly, tacking and fastening of a single part assembly.

The jig assembly and method of the present invention, provide a portable concept to aircraft component or structure assembly and fastening. The part is assembled and clamped in a jig, is moved to the fastening station for riveting and out again, freeing up the machine as noted above, for further riveting operations and at the same time, saves numerous man hours by eliminating the tacking operation noted above.

The AJ of the invention also provides swing-away pneumatic clamps as described above which allow for full access by the drivmatic anvil (and spindle), e.g. shown in FIG. 5. Such clamps can be electronically signaled by the approaching drivmatic machine to swing out of the way thereof. While pneumatic clamps with electronically signalled operation are preferred, one can also employ manually opened and closed clamps in the jig assembly embodying the present invention, as desired.

While aircraft components can readily be assembled, clamped and fastened per the invention, including aircraft spars and skin panels, various other structures, stationary or mobil, including vehicle components, can also be thus assembled and clamped in the AJ of the invention. The so-clamped components can be subsequently fastened in the AJ, e.g. by riveting, welding or other means as desired within the scope of the invention.

The AJ can of course take various shapes in accordance with the part to be assembled, provided clamps are mounted thereon for clamping the respective components together prior to the fastening step.

The contour board cross ties can be made of wood, metal or plastic and the like and can be, e.g. aluminum "sticks" about ¾ in. thick and of diminishing length, as noted above.

Beyond holding the end caps to the web (of a spar) the jig clamps of the invention shape desired contours into the spar assembly and secure it to the AJ.

What is claimed is:

1. A method for tack-free positioning of panel and stringer components for subsequent fastening, said method comprising:

positioning said components in a jig frame in a desired assembly; and clamping said stringers and said panel together and to said frame with movable clamps mounted on said frame, said clamps clamping stringers to panel to jig frame without need of further securing means, so that said components can be subsequently fastened without tacking, whereby, after fastening, said clamps can be opened to release the so-fastened components from said clamps and from said jig frame and said clamps and said jig frame can be used to repeat the above process with other panel and stringer components.

2. The method of claim 1 further comprising moving said jig and said clamped components to a fastening station, where said components are permanently fastened together while in said jig and said clamps are opened to release the so-fastened components.

3. The method of claim 2 wherein said components are fastened by a movable fastening means which transverses the perimeter of said clamped components, and said clamps are successively swung away from the components thereunder in advance of the traversing fastening means to make room therefor.

4. The method of claim 3 wherein said components are aircraft spars and aircraft skin panels.

* * * * *